US005110304A

United States Patent [19]

Kjeldahl

[11] Patent Number: 5,110,304

[45] Date of Patent: May 5, 1992

[54] ELECTRIC CONNECTOR TERMINAL, PRIMARILY A SO-CALLED ISDN-JACK, AND A METHOD OF MANUFACTURING CONTACT STRIPS THEREFOR

[76] Inventor: Poul Kjeldahl, Johs. Ewaldsvej 8, DK-8660 Skanderborg, Denmark

[21] Appl. No.: 678,948

[22] PCT Filed: Oct. 17, 1989

[86] PCT No.: PCT/DK89/00243

§ 371 Date: Apr. 17, 1991

§ 102(e) Date: Apr. 17, 1991

[87] PCT Pub. No.: WO90/04863

PCT Pub. Date: May 3, 1990

[30] Foreign Application Priority Data

Oct. 17, 1988 [DK] Denmark ..... 5769/88

[51] Int. Cl.[5] ..... H01R 4/24

[52] U.S. Cl. ..... 439/398

[58] Field of Search ..... 439/389-425

[56] References Cited

U.S. PATENT DOCUMENTS 4,212,509 7/1980 Brooks et al. ..... 439/398

4,231,632 11/1980 Badoz et al. ..... 439/398

4,315,664 2/1982 Hughes et al. ..... 439/398

*Primary Examiner*—Joseph H. McGlynn

*Attorney, Agent, or Firm*—Antonelli, Terry, Stout & Kraus

[57] ABSTRACT

In certain connector plugs use is made of contact strips (13) mounted next to each other such that at one end they form exposed contact springs (8) while at their other ends they have a loop portion (14) provided with a V- of U-shaped recess (16) for connection with a connector wire. The dimensions are rather narrow, and there is hardly room for two such recesses in each loop portion. However, there is an expressed demand for connecting two wires to some of the contact strips, and according to the invention this is made possible by shaping each strip (13) with two loops (14) mutually spaced in the longitudinal direction of the strip, where there is better room than in the width or height direction. With conventional shaping technique it is difficult to provide two loops (14) on one contact strip (13), but the invention comprises a method, which makes this possible, viz. by arranging for an active feeding of strip material to the loop areas from both sides of each of these.

9 Claims, 3 Drawing Sheets

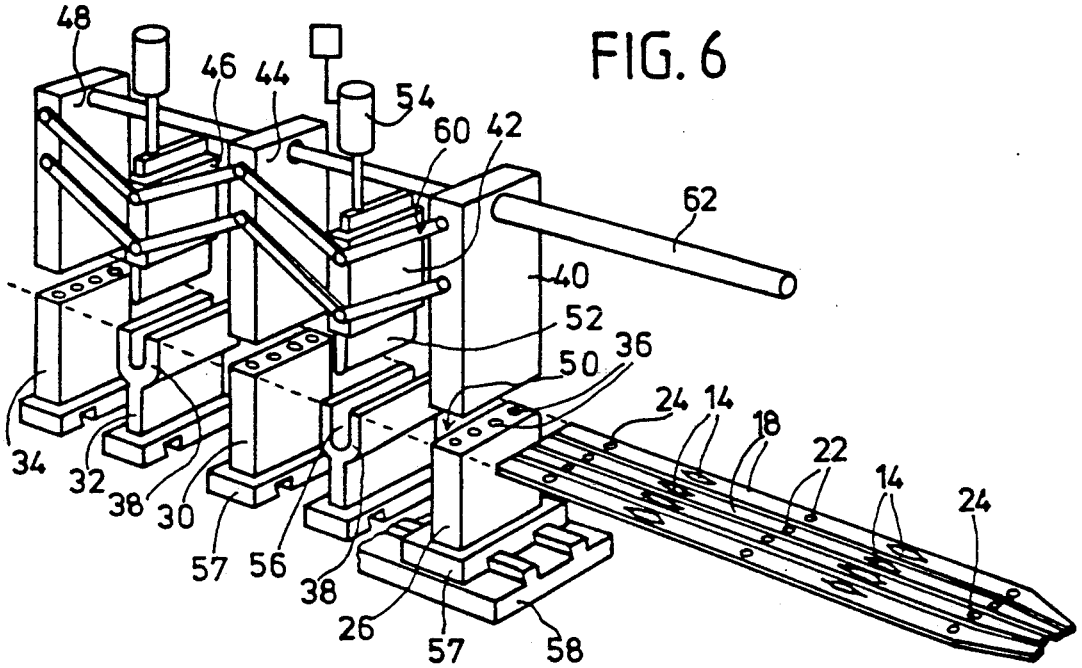
FIG. 6
FIG. 7
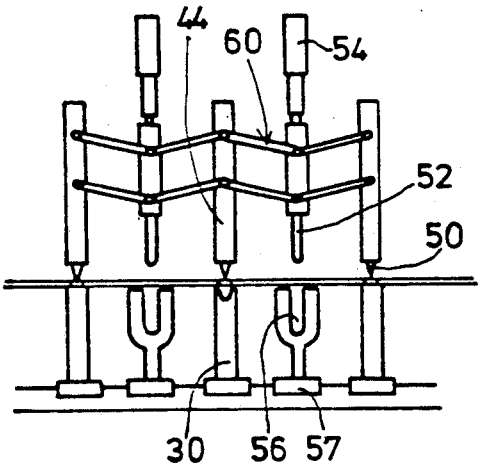
FIG. 8
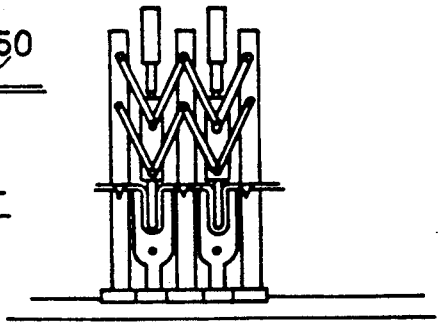

ELECTRIC CONNECTOR TERMINAL, PRIMARILY A SO-CALLED ISDN-JACK, AND A METHOD OF MANUFACTURING CONTACT STRIPS THEREFOR

FIELD OF THE INVENTION

The present invention relates to an electric connector terminal, primarily a so-called ISDN-jack, of the type in which a plurality of contact strips extend side by side between a contactor area adapted for engagement with a complementary terminal and a connector area, in which the contact strips are shaped with a bent out U- or V-loop adapted to receive respective connector wires, preferably, by receiving the wire ends in V-shaped recesses in the loop portions.

BACKGROUND OF THE INVENTION

The development tends towards a global standardization of that type of connector jacks, at least as far as the shaping of the contactor area is concerned, and it will then be essential that the associated contactor area can be provided as cheaply and suitably as possible. It is here a quite advantageous solution to make use of rearwardly projecting extensions of the flat contact strips and to shape each of these with the said loop portion, which may appear out of a surface area of a plastic body, in which the contact strips are cast in for a safe mutual anchoring with a quite small mutual spacing. Particularly when provided with the said V-shaped recesses these integrated loops will be suitable for receiving the respective wire ends without the use of further connector elements.

For ISDN jacks there are very narrow space conditions, and it is commonly acceptable that only a single wire end can be connected to each contact strip, as the possibility of a selective connection of but a single or two wire ends to the said loop will imply certain practical difficulties. In the conventional termination technique it has been possible to mount several wire ends e.g. by insertion into a connector socket or clamp, but this is incompatible with an easy wire connection to a loop on a flat contact strip.

However, it would be highly desirable if each contact strip could receive at least two connector wires in an easy manner, and according to the present invention this is achievable by the single contact strips being provided not only with a single loop portion, but with two or even more loop portions located mutually spaced in the longitudinal direction of the strip. It is very important that use can be made already of just two loops, which will allow for the connection of two wires to each contact strip with small space requirements. It has been found that the practical need for connecting more than one wire predominantly refers to just two wires, and despite the existence of this need it is to be noted that the relevant connector terminals of the prior art have not been provided with more than a single loop on each contact strip.

It has been found that with a conventional shaping technique it is very difficult in a rational production to manufacture the strips with two loop portions with the required accuracy, since there will occur a blocking of the supply of strip material to two sets of loop shaping tools operating at the same time.

SUMMARY OF THE INVENTION

In accordance with the present invention, there is provided a particular method, which makes it possible to produce strips of the aforementioned type rapidly and rationally with the use of two sets of conventional shaping tools having loop forming piston members.

This method is characterized in that the strip material is caused to be stationarily fixed in the area between the two loop bending areas and also to be fixed or clamped somewhat outside these areas, here by means of clamping tools, which are positively displaced inwardly towards the loop bending areas, and that these fixing or clamping tools, during the operation of the loop forming piston members, are caused to be positively displaced in such a manner that they will produce a controlled supply of strip material to the loop bending areas. Hereby it is achieved that the loop bending piston members shall perform nothing but their primary task, viz. to compel or guide the strip material out into the desired bent-out shape without any substantial stretching of the strip material, while the feeding of the strip material to the loop forming areas can take place by a separate feeding action, i.e. without being dependent of a pull in the strip material exerted by the piston members. By the fixation of the strip material in the area between the loop forming areas it will be obtained that no problems will arise with respect to an oblique drawing of the strip material as a consequence of unequal drawing actions by the piston members on the interfacing stretches of the two loop portions.

When the exterior fixation tools are moved into mutually well defined final positions it will also be achieved that the resulting shortening of the original, flat strip member will be accurately determined by the associated reduction of the distance between the tool sets, even if the loop bending operations should involve a certain, unknown stretching of the strip material, i.e. both the front and the rear ends of the strips will in all circumstances, be correctly located relative the location of the loop portions, this being very important particularly in view of the set of contact strips having to be partly embedded in a surrounding casting of plastic, i.e. the strips should be placed in a mould, whereby it is very critical that the strip loops as bent out from the mould cavity are located very accurately relative the contactor portions of the strips as likewise protruding from the mould cavity.

BRIEF DESCRIPTION OF THE DRAWINGS

In the following the invention is described in more detail with reference to the drawing, in which FIG. 6 is a perspective view of a system for carrying out the method according to the invention, FIG. 7 is a side view of this system, FIG. 8 is a corresponding view of the system in a final position thereof.

DETAILED DESCRIPTION

Figure 1:
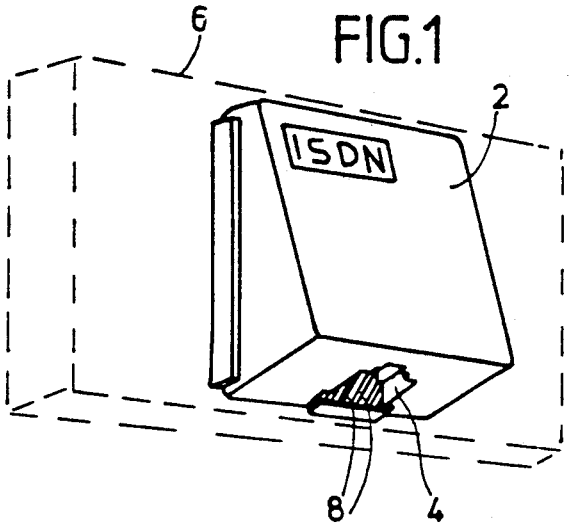
FIG. 1 is a perspective view of an ISDN-jack.

In FIG. 1 is shown a wall socket 2 having a lower receiver opening 4 for a connector jack, the socket 2 being mounted e.g. on an installation channel device 6 as shown in dotted lines. In the receiver opening 4 some contact strips 8 are visible.

Figure 2:
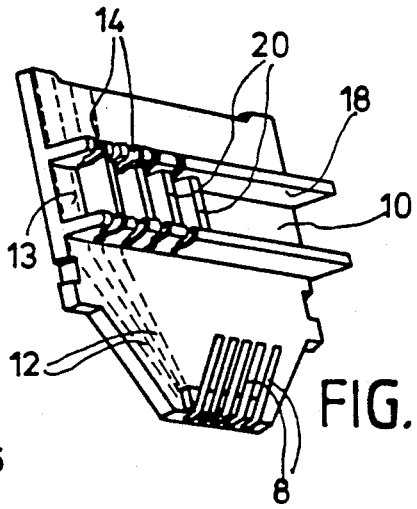
FIG. 2 is a perspective view of a main part thereof.
Figure 3:
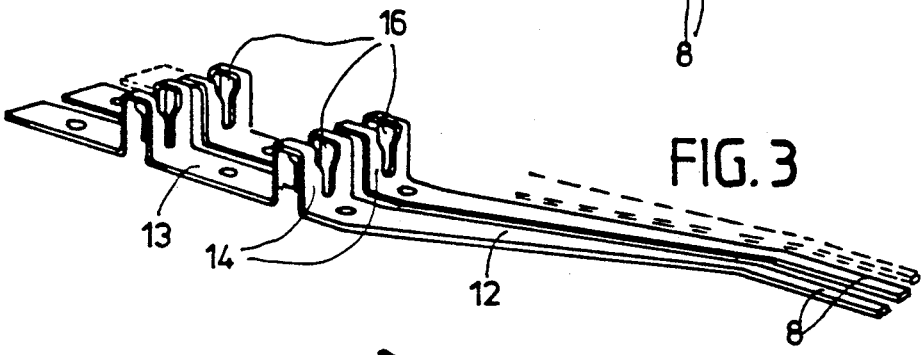
FIG. 3 is a perspective view of contact strips belonging to this main part.

These strips 8 are seen also in FIG. 2, viz. as bent out strip portions at the lower end of a plate member 10, which constitutes the main part of the socket 2 inasfar as it contains connector strips 12 between the contact strips 8 and strip portion 13, which are shaped with contact portions 14 for receiving external connector wires, with these contact portions 14 being bent out from the plate member 10. They constitute bent out portions of the strips 12, and, as shown in more detail in FIG. 3, they are provided with downwardly narrowing notches 16 suitable for receiving respective wire ends by a mere pressing down of these wire ends, whether or not they are insulated.

Figure 4:
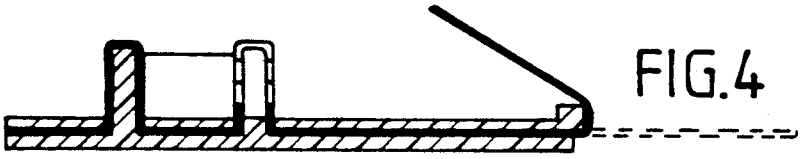
FIG. 4 is a lateral sectional view of said main part.

The contact strips 8 are quite narrow, viz. having a width of less than 1 mm, preferably 0.5 mm with a mutual center distance of 1 mm, but to the rear of the main plate member 10 they are widened into broader strips 13, on which the bent out contact portions 14 are provided. The entire contact strip set 8, 12, 13, 14 is moulded into the plate member 10, see also FIG. 4, in such a manner that the bent out loops 14 are stabilized by moulding material occurring as spotwise perforated cross ribs 18, between which there are preferably provided longitudinal connecting ribs 10. The thickness of the plate member 10 should be as small as possible, but it has been found advantageous to provide for the thickening shown at the edge of the bent out contact springs 8.

Figure 5:
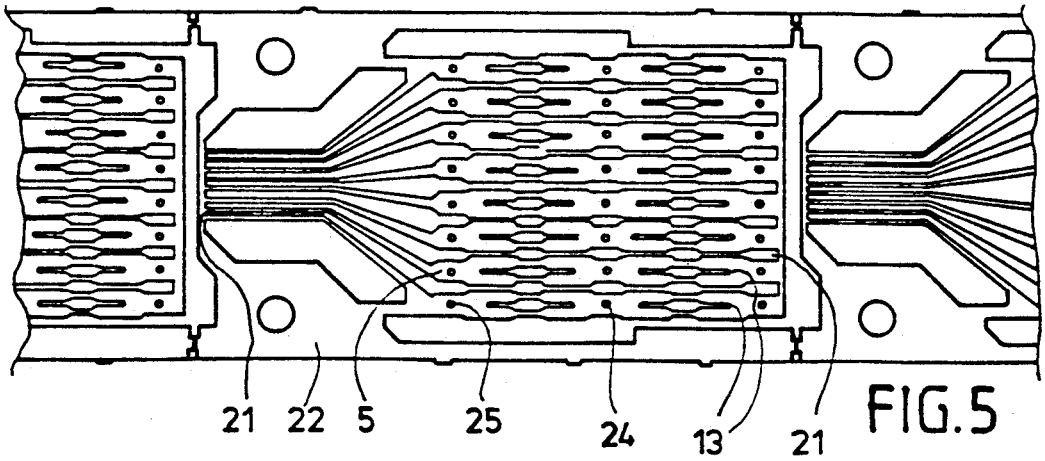
FIG. 5 is a plan view of a stamped out contact strip unit for use in the said main part.

The strip member set embedded in the plate member 10 is manufactured out of a plate material length 22 as shown in FIG. 5. This plate length, preferably consisting of a thin bronze material, is pretreated by the stamping out of consecutive strip member sets 5, i.e. by the stamping out of singular strip elements 8, 12, 13, which extend from the broad rear end area of each set forwardly to a narrowed front end area holding the outer contact strips 8. The rearmost strip portions are constituted by parallel, relatively broad strips 13, which are to be provided with loops 14, i.e. which have a length larger than the final distance between the foremost and the rearmost ends of the single contact strips in the final, embedded condition thereof. In each of the strip sets 5 the strip portions 13 are interconnected by cross strip portions 21, which are cut off at a later stage of the production, viz. after the moulding in of the strip set in the plastic body 10.

A partial area of a plate strip set 5, viz. some of the broader strip portions 13 thereof, are shown in FIG. 6 in connection with the strip set being fed to an apparatus for forming the loops 14 on these strip portions. The strip portions 13 are preshaped with the wedge recesses 16, which, after the shaping of the loops 14, will be located at the outer ends thereof, and, midway between the respective recesses 16, the strip portions are provided with middle holes 24, while corresponding outer holes 25 are provided with the same spacing outside the recesses 16. These holes are adapted to be engaged by tool means of a loop bending apparatus as described below.

This apparatus, as shown in FIGS. 7 and 8, has a row of lower tools 26, 28, 30, 32, 34, the upper ends of which are located in a common plane in which they can support the strip portions 13 of the strip member sets 5 as supplied to the apparatus in such a manner that the holes 24 become located just above the tool 30, while the recesses 16 are centered over the outer tools 26 and 34. The tools 30 and 26, 34 are provided upper holes 36, which will be located just underneath the respective holes 22 and 24 in the strip portions 13. The tools 28 and 32 have matrix heads 38 adapted for shaping the loops 14, which are thus actually shaped as downpressings.

The illustrated upper tools are correspondingly designated 40, 42, 44, 46 and 48, and they constitute a row of tools, which, after the introduction of the strip portions 13, can be lowered in common for clamping the strip portions 13 against the lower tools though this is of course achievable also by raising of the lower tools. On the lower ends of the upper tools 40, 44 and 48 are provided downwardly projecting, optionally pointed holding pins 50, which by the bringing together with the lower tools will intrude into the holes 24 and 25 of the strips 13 and further into the holes 36 in the lower tool parts 26, 30 and 34, such that the strip portions 13 will be locked very effectively to these respective pairs of interacting tools without this locking effect being conditioned solely by the associated clamping together of these pairs of tools.

The upper tools 42 and 46 are constituted by blocks, in each of which there is mounted a crosswise oriented, downwardly displaceable piston plate 52, the top of which is connected with a working cylinder 54, by means of which the piston plate 52 may be depressed into the respective, upwardly open cavity 56, in the underlying matrix head 38 for the shaping of the respective bent out loops 14.

The lower row of tools 26–34 is mounted on supports 56, which in a non-illustrated manner are horizontally displaceable in the lenght direction of the row on a guiding base 58, such that the tool parts are displaceable towards and away from each other.

The tools in the upper row are interconnected by means of a system of inclined pivot arms 60, which extend zig-zag-wise such that a forcing together of the outer tool parts 40 and 48 will result in a downwardly directed displacement of the tool parts 42 and 46, such that the piston plate portions 52 thereof will be displaced down into the matrix openings 56 in the underlying tool portions 28 and 38. For the bringing together of the outer tool members 40 and 48 it would be possible to use horizontally operating pressure cylinders 62, but it would also be possible to use pressure means for separately downwardly presses the tool members 42, inasfar as such a pressing down via the arm system 60 would result in a contracting of the outer tools 40, 48 towards each other. Additionally it will be achieved that the tool parts 42 and 46 will constantly, due to the guiding function of the pivot arms 60, be located exactly midway between the respective tools 44, respectively 40 and 48.

Thus, immediately by the initial actuation of the apparatus there will be effected both a downward pressing down of the strip portions adjacent the recesses 16 into the matrix openings 56 and a longitudinal feeding of strip material to the press down areas from both sides thereof. This feeding is effected in an active manner by the bringing together of the respective sets of clamping tools, such that it is not the piston plates 52, which shall draw the strip material down into the openings 56. When the feeding of the strip material from both sides takes place exactly with the speed, by which the material is forced down into the openings 56, then the material will be subjected almost exclusively to the influence of being bent over the edge down to the opening 56 and thereafter of being re-straightened, while it will not be subjected to any considerable pull and not at all to any oblique pull, viz. for drawing of the material across the lower ends of the piston plates 52. These lower ends will not have to exert any particular pressure on the material, but almost only ensure that the strip material is guided down into the openings 56.

In the disclosed movement system based on the arm system 60 the desirable linear relation between the material feeding speed and the speed of the downward movement of the piston plates will of course not be achievable in a direct manner, but it is perfectly possible to fully compensate for the speed differences by suitable controlling the speed of the piston plates 52 by their associated cylinders 54. In the initial phase the downward motion of the tool parts 42 and 44 will take place much faster than the feeding motion, but it is possible, then, to effect a relative lifting of the piston plates such that a synchronous piston displacement will occur anyway. Correspondingly, during the final phase of the depressing of the material into the openings 56 it will be relevant to effect an accelerated lowering of the piston plates for maintaining their synchronous speed. On this background it is important that the cylinders 54 be controlled with a good accuracy from a control unit 62 or that the synchronous movements are obtained by other kinds of control means. The primary task of the arm system 60 is to ensure that the feeding movements will take place in a synchronous manner from both sides, but it will be appreciated that even this could be achievable otherwise.

If the central clamp tools 30, 44 are held in a stationary position, then the outer ends of the strip portions 13, i.e. to the left of the apparatus according to FIGS. 6 and 7, will be drawn towards the right, while the entire feeding strip 22 at the right hand side of the apparatus will be pulled correspondingly to the left, yet only as much as corresponding to the strip material consumption for the formation of the loop 14 in the right hand tool 28, 42. If the right hand clamp tool 26, 42 is kept stationarily, the working will not produce any feeding movements of the feeding strip.

It should be added that the advantages of the disclosed active material feeding will be substantial even for the production of but a single loop 14 or more than two such loops or other kinds of deformations. These would not even have to be of uniform size, inasfar as the apparatus may well be designed with individually adapted tools and moving mechanisms for each single operational section. It is even possible to make use of individual movement means for each pair of the cooperating tools, e.g. with the use of step motors controlled or programmed for highly accurate cooperation.

Figure 9:
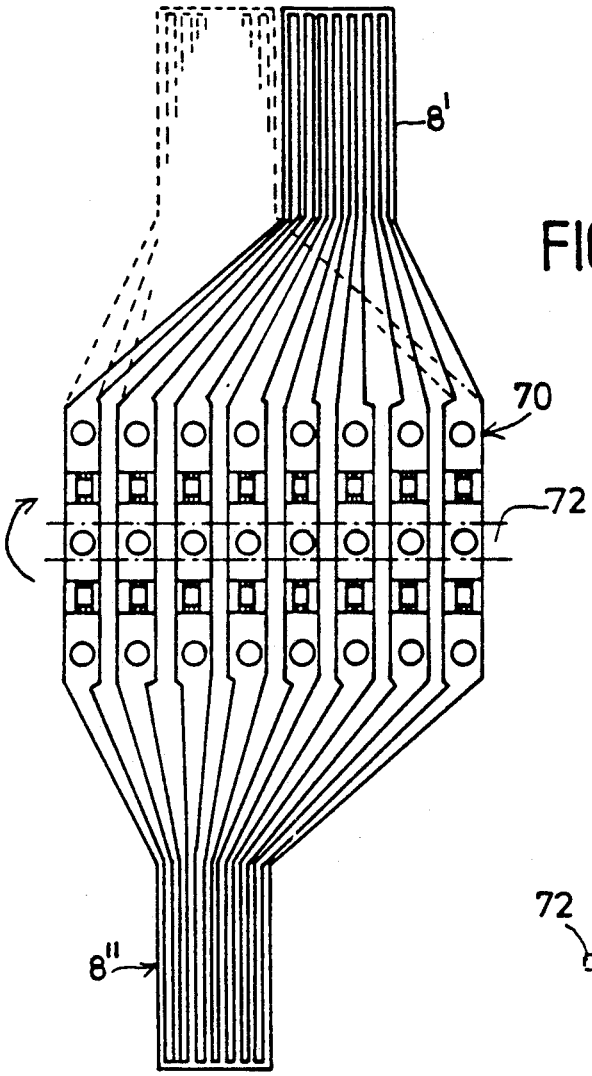
FIG. 9 is a plan view of a contact strip member for a modified ISDN-jack.

In FIG. 9 is shown a contact strip unit 70, in which the strip portions 13 are extended at both ends into contact strip areas 8' and 8'', which are mutually staggered such that by a folding of the unit about a transverse middle area 72 these areas can be brought into a side by side location, which is indicated in dotted lines. The folded unit can be cast into a common body 74 (FIG. 10) from which the contact strips 8 in the two areas 8' and 8'' will be projecting as one long row of contact springs, and from which the bent out loops will project to opposite sides. It can in fact be desirable that one and the same strip portion 13 is electrically accessible through two terminal strips or springs 8.

Figure 10:
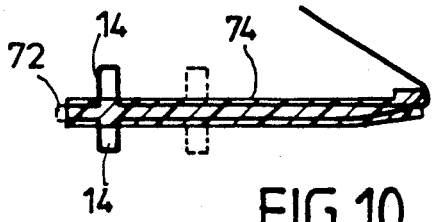
FIG. 10 is a longitudinal sectional view of a main portion of such a modified jack.

As indicated in FIG. 10, the strips 13 may be cut between the loops 14, e.g. by an associated removal of the folding area 72, whereby the number of different connector strips will be doubled, although each of them will now have but a single loop 14. It would be possible, however, to provide each strip with four loops, e.g. by a repeated treatment according to FIGS. 6–8, such that each individual strip portion may nevertheless be provided with two loops.

Figure 11:
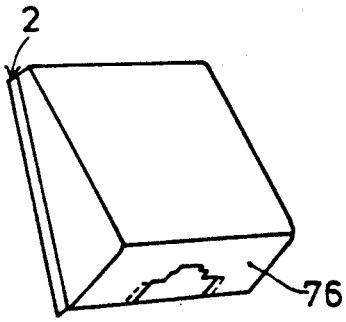
FIG. 11 is a view corresponding to FIG. 1, representing a rechangeable cover element.

It is shown in FIG. 11 that the socket 2 may be provided with a cover 76, the receiving opening 4 of which may be relatively narrow, it being shown in dotted lines which width the opening should have for enabling an insertion of a connector jack for cooperation with all the contact strips 8. By way of example a choice may be made between six or four contacts, respectively. Hereby the same socket may be used in both cases, provided the correct cover 76 is chosen.

Figure 12:
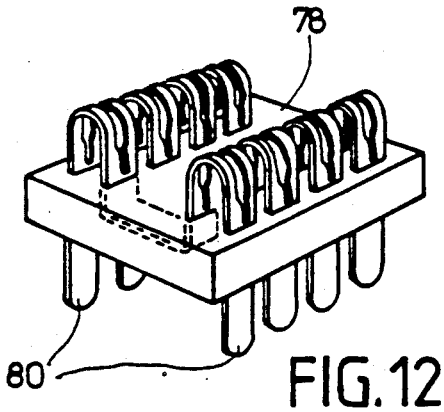
FIG. 12 is a perspective view of a terminal block designed according to the invention.

FIG. 12 illustrates a terminal block shaped with jack legs 80, which, pairwise, are extensions of crosswise arranged contact strips each being shaped with two loop portions in accordance with the invention.

I claim:

1. An electric connector terminal comprising a plurality of contact strips extending side by side between a contactor area adapted for engagement with a complementary terminal and a connector area, each of said contact strips including at least two bent out U-shaped or V-shaped loop portions adapted to receive respective connector wires in a recess in said loop portions, and wherein said at least two loop portions are arranged mutually spaced in a longitudinal direction of the contact strips.

2. A terminal accoding to claim 1, wherein the contact strip at both ends are connected with outwardly protruding contact springs and are folded at an area between two of the loop portions such that mutually staggered contact spring areas are located side by side and substantially in a common plane.

3. An electric connector terminal according to claim 1, wherein a connector terminal is an ISDN-jack.

4. A method of manufacturing a set of contact strips for use in a connector terminal, primarily a so-called ISDN jack, of the type in which a plurality of contact strips extend side by side between a contactor area adapted for engagement with a complementary terminal and connector area, in which the contact strips are shaped with a bent out U- or V-shaped loop adapted to receive respective connector wires, preferably, in a V-shaped recess in these loops, each contact strip is shaped with two or more loop portions arranged mutually spaced on the length direction of the contact strips, shaping a U- or V-bent, outwardly protruding loop on the strips by a deformation of these out into a matrix tool, characterized in that for the shaping of the two loops on each strip use is made of two consecutively arranged matrix tool, which are displaceable towards and away from each other, and of correspondingly displaceable strip holders located at respective opposite sides of the set of matrix tools, such a strip holder preferably being provided also midway between the matrix tools, whereas the deformation of the strips is effected by a controlled bringing together of both the matrix tools and the strip holders in such a manner that the respective strip portions, by the associated diminishing of the distance between the strip holders, will be brought to progressively bulge into a shaping opening in the respective matrix tools, assisted by a guiding piston which is introduced into the shaping opening in synchronism with the compulsory feeding of the strip material to be respective shaping openings.

5. A method according to claim 4, characterized by the use of strip holders and matrix tools with associated guiding pistons, which are coupled together in a fixed mechanical system including parallellogram-held guide means, which, by said bringing together, continually maintain a positioning of the matrix tools and the guiding pistons or guiding means for these parts midway between the adjacent strip holders, whereby these guiding means are concurrently brought nearer towards the strip, the guiding pistons being controlled in such a manner relative to the movement of the respective guiding means that the ends of the guiding pistons carry out a resulting, even and synchronous motion into the matrix openings.

6. A method according to claim 4, characterized in that contact strips having contact spring terminals at both ends are provided with the loop portions and are then folded at an area between the loops for providing a double contacting area on the finished, cast-out terminal element, the strips optionally being cut through in the folding area after being cast out.

7. A method of manufacturing a set of contact strips for a connector terminal, the method comprising the steps of:

providing at least two consecutively arranged matrix tools;

providing a contact strip holder at opposite sides of the at least two consecutively arranged matrix tools;

feeding the strip material between the at least two matrix tools and the strip holders; and relatively displacing said matrix tools and said strip holders with respect to each other so as to deform each of said contact strips into at least two bent U-shaped or V-shaped loop portions mutually spaced in a longitudinal direction of the contact strips for receiving respective connector wires of the connector terminal.

8. A method according to claim 7, wherein said connector terminal is an ISDN-jack.

9. A terminal according to claim 1, wherein said recess in said loop portions is V-shaped.

* * * * *